United States Patent [19]

McGinnis

[11] 4,077,583

[45] Mar. 7, 1978

[54] NON-ROTATING SKI-ROPE RETRIEVER

[76] Inventor: Lee R. McGinnis, P.O. Box 205, Loami, Ill. 62661

[21] Appl. No.: 611,358

[22] Filed: Sep. 8, 1975

[51] Int. Cl.[2] ..... B65H 75/40; B63B 21/56

[52] U.S. Cl. ..... 242/85.1; 114/254; 242/86.5 A; 242/106

[58] Field of Search ..... 242/85.1, 86.5 A, 96, 242/106, 54, 222; 114/235 WS, 254, 253

[56] References Cited

U.S. PATENT DOCUMENTS

| | | | |
|---|---|---|---|
| 2,573,636 | 10/1951 | Wilson | 242/85.1 |
| 3,638,876 | 2/1972 | Bullock | 242/86.5 A |
| 3,885,754 | 5/1975 | Delerue | 242/54 R |
| 3,926,383 | 12/1975 | McConnell | 242/85.1 |

*Primary Examiner*—George F. Mautz
*Attorney, Agent, or Firm*—Ralph F. Staubly

[57] ABSTRACT

The disclosure is a non-rotating ski-rope retriever having a reel-like drum molded of a tough and preferably smooth flexible plastic material. The drum is easily removable from a support adapted for semi-permanent attachment to the transom and/or the rear deck of a motor-boat, and is swingable from a vertical-axis position for easy manual winding-up of the ski rope to a paying-out position in which the axis is generally horizontally disposed but preferably with a downward and rearward inclination to lessen friction as the rope slides over the top edge of the drum. If the drum is made of flexible plastic material its rear flange will also flex to further reduce the friction as needed.

10 Claims, 6 Drawing Figures

NON-ROTATING SKI-ROPE RETRIEVER

BACKGROUND

Most ski-rope retrievers of the prior art employ rotating reels. A few, e.g. Steward U.S. Pat. No. 3,113,563 and Palmieri U.S. Pat. No. 3,498,563, use a fixed-axis non-rotating drum and a rack-driven arm for winding-up the rope and for guiding the paying-out thereof. The bearings of rotating parts are susceptible to wear or to binding by dirt or corrosion, and are more costly to manufacture. Most prior-art retrievers are bulky when not in use, and cranks constitute obvious hazards.

SUMMARY OF THE INVENTION

The objects of the present invention are to overcome most of the disadvantages of the prior-art devices by providing a ski-rope retriever that is very economical of manufacture and upkeep; that is quickly and easily attachable to and detachable from a small semi-permanently installed support; and that is swingable from its use position to a position for easy manual winding-up of the ski rope, for secure storage of the rope, for minimal space use, and for minimal personal-injury hazard. Other objects and advantages will appear as the following description proceeds.

Figure 1:
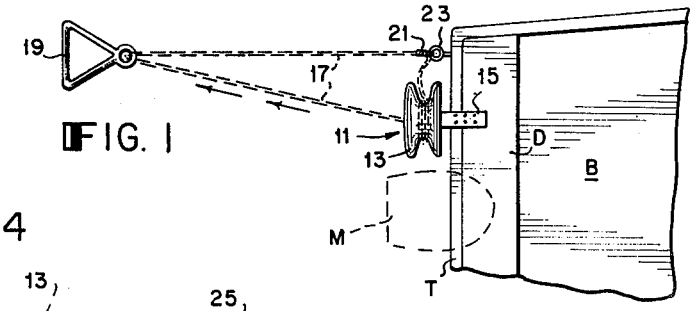
FIG. 1 is a plan view of the preferred form of the invention in its use position.

With reference now to the drawings, the numeral 11 generally designates the retriever, which comprises a reel-shaped drum 13 and its support 15. Numeral 17 is a conventional ski rope, 19 a conventional tow bar, and 21 a common dog-leash-type spring clip for releasably attaching the boat end of a ski rope to an eye-screw 23 fixed to a boat transom T of a boat B, which boat is shown as having an outboard motor M and a rear deck D. The spring clip 21 can be omitted and the rope simply tied to the eye-screw 23.

The drum 13 is preferably made of a tough, smooth and preferably flexible plastic material, but could be made of corrosion-resistant metal (e.g. aluminum). As shown it is made of several pieces thermoplastically welded or cemented together. The rear (when upright) or upper (when folded-down) part 25 has its open face closed by a slightly curved disk 27 for increased strength, improved appearance and water-exclusion. The rear (when upright) or lower (when folded-down) drum part 29 has a stepped flange 31 defining a seat for a flange 33 on the part 25, the mating flanges being thermoplastically welded or cemented together. A solid bar or block 34 is either molded integrally with the drum part 29 or later fixed thereto. The bar 34 has depressions 35 (for a purpose hereinafter described) and a transverse bore 38 to receive a removable hinge pin 39 for quick and easy attachment and detachment of the drum 13 to and from its support 15.

Figure 4:
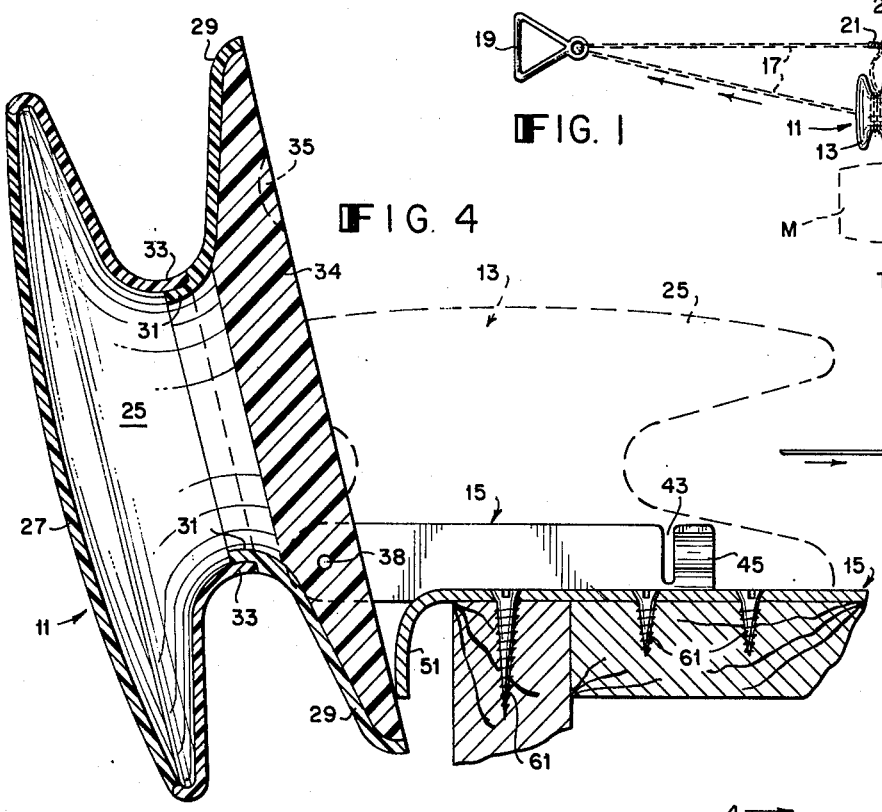
FIG. 4 is an elevational view of the showing of FIGS. 1 and 3 taken on the line 4—4 of FIG. 3.
Figure 5:
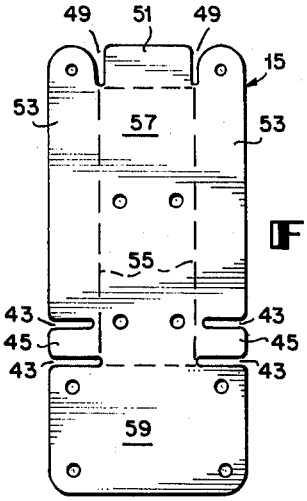
FIG. 5 is a plan view of the sheet-metal blank from which the semi-permanently attached support is formed by bending.

The support 15 could be molded of stiff reinforced plastic material, but is preferably formed from a flat corrosion-resistant sheet-metal blank, blendable along the dashed lines as shown in FIG. 5. Slots 43 define fingers 45 bendable upwardly and bowed to form detent protuberances 47, which are engageable in detent depressions 35 (FIGS. 3 and 4) when the drum 13 is in its folded-down position of FIGS. 2 and 4.

Slots 49 define a tab 5 bendable downwardly to constitute a stop member 51 for holding the drum 13 in its rearwardly tilted position of FIG. 4. Slots 43 and 49 also define strap portions 53 which, when bent up along lines 55, constitute the side elements of the support 15. Blank portions 57 and 59 lie flat on the upper edge of transom T and on an adjacent coplanar portion of deck D, and are semipermanently attached thereto by screws 61 (or bolts).

Figure 3:
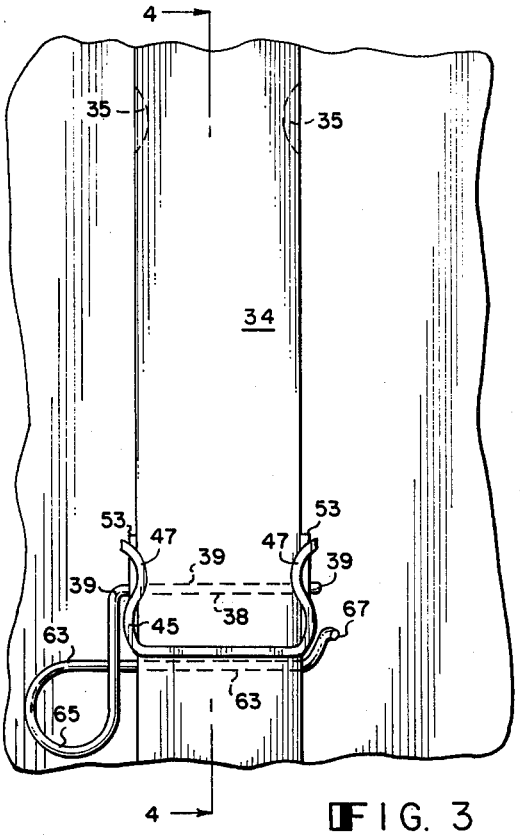
FIG. 3 is a enlarged central-portion elevational view from the right in FIG. 1.

The hinge pin 39 can be of any known easily removable type but could be formed, as shown in FIG. 3, with second portion 63 parallel to the hinge portion 39 and joined to it by an integral spring loop 65. The free end of portion 63 is bent to form a catch 67 releasably engageable under the edge of the base of support 13 to fasten the hinge pin 39 in place and to permit its easy removal.

Figure 2:
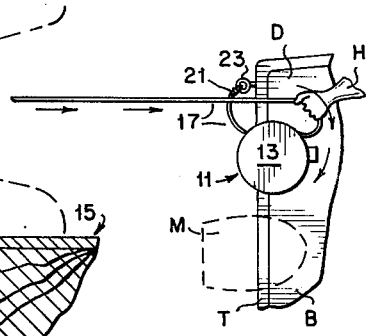
FIG. 2 is a plan view of the device in its retrieving and storage position.

In FIG. 2, the hand H and the arrows show how the rope is manually retrieved and stored.

Figure 6:
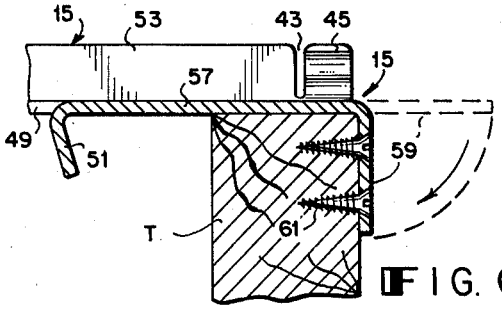
FIG. 6 is a partial view similar to FIG. 4, but showing the support of FIGS. 3 and 4 with an additional bend for transom-only mounting (instead of the transom-and-deck mounting of FIG. 4).

The support portion 59 is bendable downwardly, as shown in FIG. 6, to permit transom-only mounting of the retriever 11.

Having thus described my invention, I claim:

1. A ski-rope retriever comprising: a non-rotating reel-shaped drum having two peripheral flanges defining an annular pocket, generally U-shaped in transverse cross-section, adapted to receive a ski rope manually wound therein; a support adapted for attachment to rear stern structure of a towing boat or the like; said drum and said support having cooperating means defining a horizontal-axis hinge and limiting movement of said drum between a rearwardly facing generally vertical position for circumferential overedge paying-out rope and a generally horizontal folded-down position for facilitating manual winding-up and for secure storage of said rope.

2. Structure according to claim 1, said drum being molded of tough, smooth, flexible plastic material, whereby the rear flange may flex to assist rearward paying-out of said rope.

3. Structure according to claim 2 wherein said co-operating means limits movement of said drum in its generally vertical position to a somewhat downwardly facing position.

4. Structure according to claim 1 wherein said cooperating means limits movement of said drum in its generally vertical position to a somewhat downwardly facing position.

5. Structure according to claim 1 and additionally comprising means for quickly and easily attaching the boat end of a ski rope to stern structure separate from the retriever to relieve said retriever of towing strain when the ski rope is fully paid-out.

6. Structure according to claim 1, the rear face of said drum and said support having co-operating detent means for holding said drum in its folded-down position.

7. Structure according to claim 6, said support being formed of sheet material and having integral upstanding fingers constituting parts of said detent means.

8. Structure according to claim 1, said support structure being formed from a blank of sheet material and having bent-up flanges forming parts of said hinge.

9. Structure according to claim 8, said support blank having a downwardly bendable rear portion, whereby said support may be mounted either on a transom only, or on both a transom and adjacent deck structure.

10. Structure according to claim 1, said hinge having an easily and quickly insertable and removable hinge pin, whereby the drum may be removed from said boat when not in use.

* * * * *